United States Patent [19]

Murakami et al.

[11] 4,079,898

[45] Mar. 21, 1978

[54] DOFFING AND DONNING MACHINE

[75] Inventors: Shiro Murakami; Takeshi Kato, both of Matsuyama, Japan

[73] Assignees: Teijin Limited; Teijin Seiki Co., Ltd., both of Osaka, Japan

[21] Appl. No.: 745,051

[22] Filed: Nov. 26, 1976

[30] Foreign Application Priority Data

Dec. 2, 1975 Japan ..... 50-142413

[51] Int. Cl.[2] ..... B65H 54/20; B65H 67/04

[52] U.S. Cl. ..... 242/35.5 A

[58] Field of Search ..... 242/35.5 A, 35.5 R, 242/18 R, 18 A, 19, 18 DD, 35.6 R; 57/34 R, 53, 52

[56] References Cited

U.S. PATENT DOCUMENTS

| | | | |
|---|---|---|---|
| 3,791,126 | 2/1974 | Kose et al. | 242/18 R X |
| 3,811,631 | 5/1974 | Mayer et al. | 242/35.5 A X |
| 3,820,730 | 6/1974 | Endo et al. | 242/35.5 R |
| 3,915,398 | 10/1975 | Corl | 242/35.5 A |
| 3,948,452 | 4/1976 | Burysek et al. | 242/35.5 A X |

*Primary Examiner*—Stanley N. Gilreath

[57] ABSTRACT

Disclosed is a doffing and donning machine used for a textile machine such as a false-twisting machine or a draw-texturing machine in which a plurality of winding units is arranged in several rows and in several stages on the package stand; a travelling carriage travels along the package stand and has at least two subtrucks which can approach near the winding units and move far from the winding units on each of said subtrucks a doffing and donning mechanism is mounted.

7 Claims, 21 Drawing Figures

47
57
67
41
70
69
68
111
79
76
77
78
75
62
65
116
113o
115
115o
28
X
88
58
86
81
80
82
85
87
84
83
63
84
87
27
26
25
66
73
72
74
71
61
B
24
22
32
19
IX
IX
18'

DOFFING AND DONNING MACHINE

The present invention relates to a doffing and donning machine, more specifically, to a machine which doffs a full package from a winding unit and dons an empty bobbin thereon, wherein a plurality of winding units is arranged in a multirow and multistaged arrangement on a package stand, and a plurality of package stands are arranged in parallel and in rows.

In a false-twisting machine or a draw-texturing machine, a row of a plurality of winding units is arranged in multistages within one winding stand, wherein on the winding units, a draw textured yarn is wound on a bobbin and into a package. Thus, the space occupied by the stand is utilized effectively, and the operational efficiency of the winding units during the doffing and donning operation is high.

Recently, a draw texturizing process, in which a drawing process and a false-twisting process are sequentially or simultaneously arranged, has been practically utilized. By using this process, it is possible to speed up the running speed of a yarn drawn in this process and, therefore, a large size package may be wound on this machine. Because of the higher speed of said yarn running in the machine, and also because of the larger package being wound on the machine, however, this process has disadvantages, such as requiring skilled workers and heavy manual labor in the operation of doffing of the large package from a winding unit. Consequently, there is a requirement for doffing the large packages mechanically and there are many concepts on how to do this. According to one of these concepts, the mechanical doffing is carried out by arranging a large plurality of winding units in multistages on a one-package stand and, then, arranging a plurality of the package stands in a row. In this concept each of the winding units is incorporated with a doffing device and a threading device. A drawback concerning this concept is that the same number of doffing devices and threading devices as the number of winding units are required. This means that the cost of installing such devices is very high and that the cost of the labor necessary for maintenance of the devices is also very high.

One way to solve such a problem is by providing a doffing and threading assembly of a travelling type, wherein the assembly is assigned to only one row of the winding units arranged in one stage on one package stand. In this case, one assembly functions for all of the winding units arranged in one of the rows in one stage, so that all of the packages wound on said winding units are doffed by said assembly. However, a drawback in this assembly is that, one doffing and threading assembly is necessary for each stage. In addition to this, it is necessary to provide one travelling mechanism for moving each of said assemblies and also to provide one positioning mechanism per assembly. Consequently, the total cost of the many travelling mechanisms and positioning mechanisms becomes inevitably high. A further drawback is that when many such mechanism are assembled within each stage on a package stand of a machine, the operational efficiency of said machine provided with such complicated mechanism is low.

The present invention is directed to a way of solving the problems producing the drawbacks mentioned above. The device of the present invention comprises a trolley frame travelling along a package stand, a plurality of subtrucks mounted on said trolley frame in such a way that each of said subtrucks can approach near and move far from a winding unit, and one doffing and donning mechanism mounted on each of said subtrucks.

An object of the invention is to provide a machine which is characterized by having a plurality of doffing units on a travelling carriage, each of which doffing units is disposed so as to correspond to a separate winding unit, and after the carriage moves from one position to another position, a plurality of winding units can be doffed simultaneously. This means that: the doffing capability of one doffing machine of the present invention assigned to a large number of winding units is greater than that of the doffer with only one doffing unit; the required number of travelling mechanisms and also positioning mechanisms of the present invention is substantially reduced when compared to the doffer with only one doffing unit, and; the installation cost for said doffing machine, and travelling and positioning mechanisms per given number of winding units can be substantially decreased.

Another object of the invention to provide a machine, in which by mounting subtrucks on a travelling carriage, it is possible to move a doffing unit far from a winding unit when it is required to move the travelling carriage along a package stand, and; by providing at least two subtrucks on the travelling carriage, each subtruck having a doffing device assigned to a winding unit can be arranged on the travelling carriage.

As the travelling carriage is constructed as mentioned above, the subtruck is mounted on the travelling carriage in such a way that it can approach near and move far from the corresponding winding unit. In addition, it is also possible to move said doffing unit near said winding unit after stopping the movement of said travelling carriage at any position, where a doffing unit enters into a position just in front of a winding unit. This means that the doffing unit can approach as close as possible to the winding unit. By constructing the travelling carriage as mentioned above, the lateral movement of the doffing unit is not limited by a reinforcing column even when a reinforcing column is arranged between the adjacent winding units. A further advantage in this arrangement is a reliable doffing operation of the doffing unit, because the doffing unit can be made to approach near said winding unit.

A further object of the present invention is to provide a particular carriage which may be of a hanging monorail type. It is possible to use this carriage for a false-twisting machine or a draw-texturing machine in which a plurality of winding units are arranged at the same level as that of the lower part of the body of the machine, and an aisle disposed between them is preferably used for a space where an operator rethreads a broken yarn occurring on a winding unit. The usual drawback in such a false-twisting machine or draw-texturing machine provided with the above-mentioned arrangement is that, if the travelling of said carriage is obstructed by anything within the working area where a worker is rethreading a broken yarn, the working efficiency of said carriage will be decreased due to such obstruction. Furthermore, generally, below said working area, there is a plurality of slits for yarns to pass through, wherein the yarn extends from the body of the false-twisting machine or draw-texturing machine to the winding unit. Consequently, if the carriage moves across said slits and along the aisle the carriage receives a shock each time it passes over a slit. Such shock on the carriage reduces the operational steadiness of the doffing operation of this device. Such a drawback as mentioned above can be completely eliminated by utilizing the arrangement of the present invention.

Another object of the invention is to provide a swinging device may be provided on a doffing unit for swinging the cradle of a winding unit. A continuous operation, which involves swinging a cradle, doffing a full package and threading a yarn onto a winding unit, can be carried out automatically with such an arrangement.

A preferred embodiment of the invention will now be described by way of examples and with reference to the accompanying drawings, in which.

DRAW TEXTURING MACHINE

Figure 1:
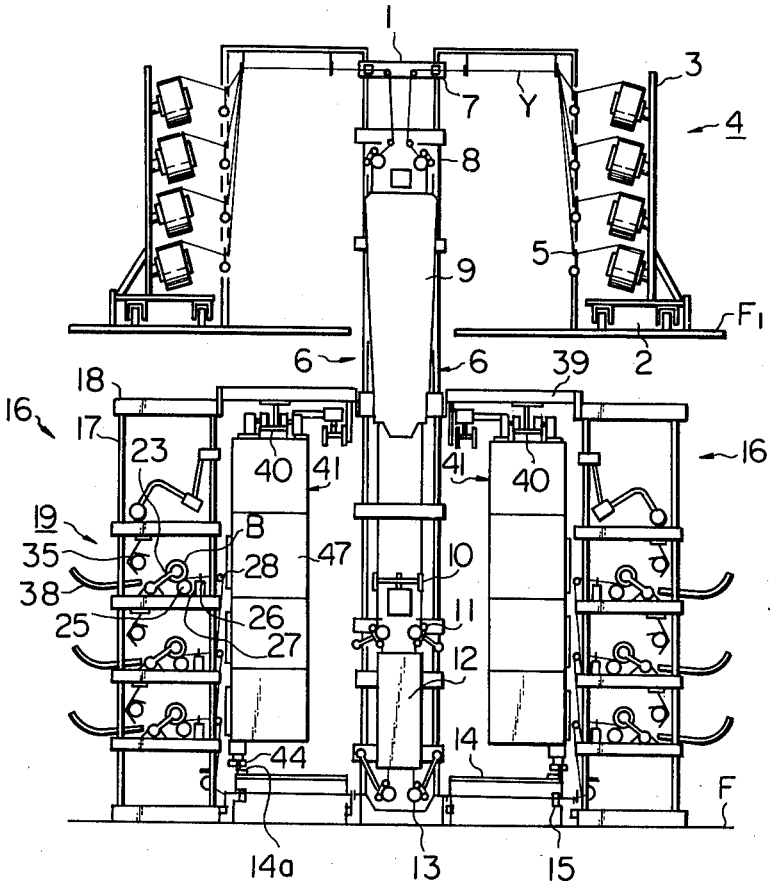
FIG. 1 is a side view showing a draw-texturing machine provided with a doffing and donning machine of the present invention.

FIG. 1 shows a draw-texturing machine comprising a frame 1 installed on a ground surface F. The upper part of the main frame 1 projects upwardly through and beyond an upper floor $F_1$ arranged above the ground surface F. A yarn supplying section 4 comprises a creel assembly carrier 3, for supplying yarn to the draw-texturing section while said carrier is arranged at a position facing the upper part of the frame 1. The carrier is so constructed that it can be moved on a transporting rail mounted on the upper floor $F_1$. Two winding sections 16, on two package stands, are arranged at a position facing the main frame 1 mounted on the ground surface F. One half of a plurality of draw-texturing sections 6 within one main frame 1 are arranged on each side of the main frame 1, respectively. The draw-texturing section 6 comprises a yarn cutter 7, a feed roller 8, a first heater section 9, a false twisting device 10, a first delivery roller 11, a second heater section 12 and a second delivery roller 13. Between the yarn supplying section 4 and the main frame 1, there is provided a yarn guide 5, and between the winding section 16 and the main frame 1 there is provided a worker deck 14 having a plurality of slits for yarn to pass therethrough. Under the worker deck 14, a feeler 15 is provided. The feeler 15 acts to operate the yarn cutter 7 when the yarn tension on a running yarn becomes low.

WINDING SECTION

Figure 2:
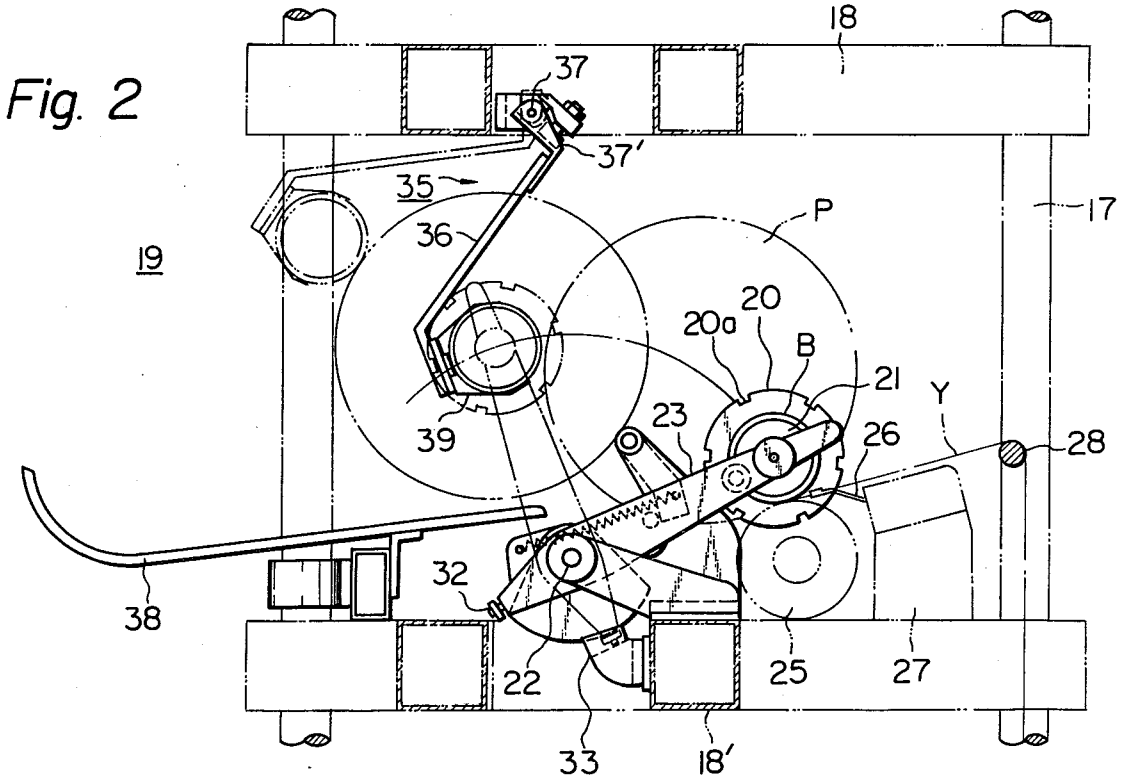
FIG. 2 is a side view showing one winding unit provided on a draw-texturing machine.
Figure 3:
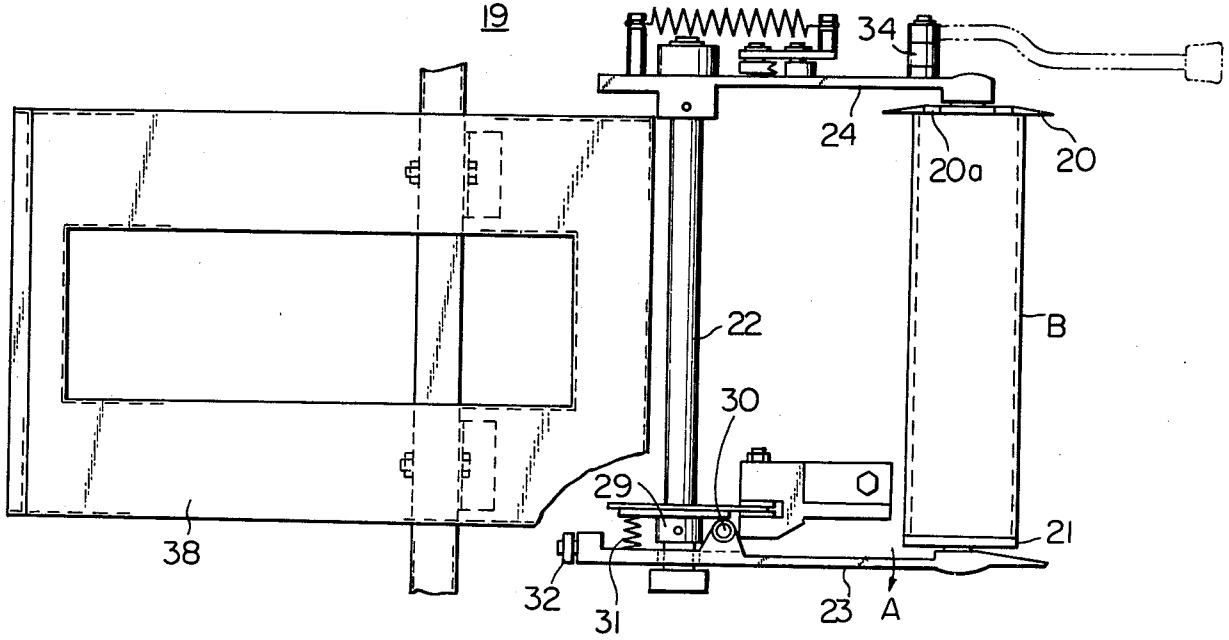
FIG. 3 is a plan view of a winding unit as shown in FIG. 2.

As shown in FIG. 1, a winding section 16 comprises a plurality of winding units 19 which are arranged on a package stand consisting of a vertical stand 17 and an upper frame 18. The winding units 19 are arranged in such a way that each of the three rows of the winding units 19 is mounted on one of the three stages in the winding section 16. Between adjacent groups of eight winding units, a vertical stand 17 is arranged so that it reinforces the construction of the winding section 16. As shown in FIGS. 2 and 3, a winding unit 19 comprises: a pair of bobbin holders 20, 21, which turnably support a bobbin B for winding yarn thereon; a pair of swingable cradles 23, 24, which support the holders 20 and 21, and also pivot around a shaft 22 of the winding units; a friction roller 25, which frictionally drives the bobbin B and is mounted on a line shaft of the draw-texturing machine and; a traversing device 27 provided with a traversing guide 26. A yarn path deflecting guide 28 is arranged at a position upstream from the traversing device 27.

Referring to FIG. 3, the cradle 23 is pivoted on a pin 30 mounted on a boss 29, fixedly mounted on the shaft 22, and by this pivoting of the cradle 23, the bobbin holder 21 approaches near an end of the bobbin held by the cradles 23 and 24. Consequently, the distance between the bobbin holder 20 mounted on the cradle 24 and the bobbin holder 21 mounted on the cradle 23 can be varied. By providing a compression spring 31 between the cradle 23 and the boss 29, the bobbin holder 21 has a tendency to be moved toward the bobbin holder 20. A cam follower 32 is provided at the end of the cradle 23. A cam surface 33, which has a tapered surface, as shown in FIG. 2, is attached to the bottom frame 18' of the winding section 16, and the cam follower 32 contacts this cam surface 33. When the cradles 23 and 24 are turned counterclockwise in FIG. 2, the cam follower 32 mounted on the cradle 23 comes into contact with the cam surface 33 and, as shown in FIG. 3, this causes the cradle 23 to swing around the pin 30 in the direction of the arrow A in FIG. 3 against the spring force of the spring 31. This causes the bobbin holder 21 on the cradle 23 to move away from the bobbin holder 20. The cradle 24 is fixedly mounted on the shaft 22 and provided with a guide roller 34 on the side thereof. A dent, or dents, **20*a* for yarn catching is provided on the bobbin holder 20**.

As shown in FIG. 2, an empty bobbin supporter 35 comprises an arm 36 rotatably mounted on the upper part of the upper frame 18 by means of a pin 37, and a bobbin holding element 39 of angled configuration is mounted on the top part of the arm 36. A stopper 37' is provided on the upper frame 18, for defining the position of the arm 36. A full bobbin pan 38 is mounted on the lower frame 18' underneath the empty bobbin supporter 35.

DRAW-TEXTURING MACHINE

A partially oriented synthetic yarn withdrawn from the yarn supplying section 4, is drawn at the draw-texturing section 6 and, simultaneously or sequentially, it is false twisted. Then, said drawn and textured yarn is wound on a bobbin B driven by the friction roller 25. The yarns are wound on the bobbin B in the form of a cross winding, due to the guidance of the traversing device 27, after they pass through the path disposed under the worker deck 14 and are guided by the yarn path deflecting guide 28, so that the direction of the running of said yarns is varied.

After the package becomes a full package P, the cradles 23 and 24 are turned counter-clockwise in FIG. 2, so that the bobbin of the full package P is separated from the surface of the friction roller 25. When the cradles 23 and 24 are turned further in the same direction, the full package P comes into contact with the empty bobbin supported on the empty bobbin supporter 35, so that the supporter 35 is turned around the pin 37 and the full package P passes underneath the empty bobbin supporter 35, and finally, the cam follower 32 comes into contact with the cam surface 33. This causes the bobbin holder 23 to swing in the direction of arrow A in FIG. 3, and to drop the full package P onto the full bobbin pan 38. When the full package P is placed on the pan 38, the empty bobbin supporter 35 is moved by its own weight to its original position, indicated by a solid line in FIG. 2. Then, the cradles 23, 24 are turned clockwise in FIG. 2. When the bobbin holders 20 and 21 reach the position where an empty bobbin is being held by means of the empty bobbin supporter 35, the cam follower 32 on the cradle 23 is separated from the cam surface 33. At this position, the cradle 23 and bobbin holder 21 are turned in the opposite direction from that indicated by the arrow A in FIG. 3 by means of the spring 31, and this causes the empty bobbin B to be held between the two bobbin holders 20 and 21. After this condition occurs, the cradles 23 and 24 holding a bobbin B are turned in the clockwise direction in FIG. 2, and finally, the empty bobbin B comes into contact with the surface of the friction roller 25 and the winding of a yarn onto said bobbin B can be commenced.

DOFFING AND DONNING MACHINE

Figure 4:
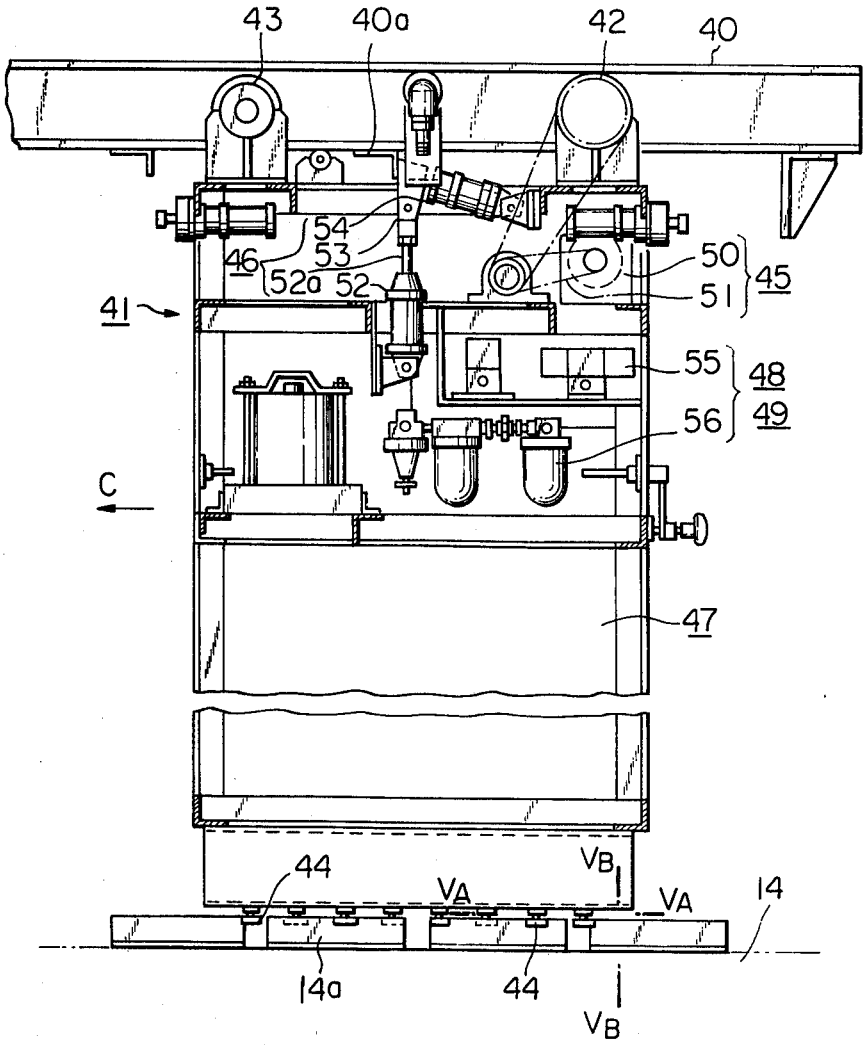
FIG. 4 is a front view showing the back side of a doffing and donning machine as shown in FIG. 1.
Figure 5A:
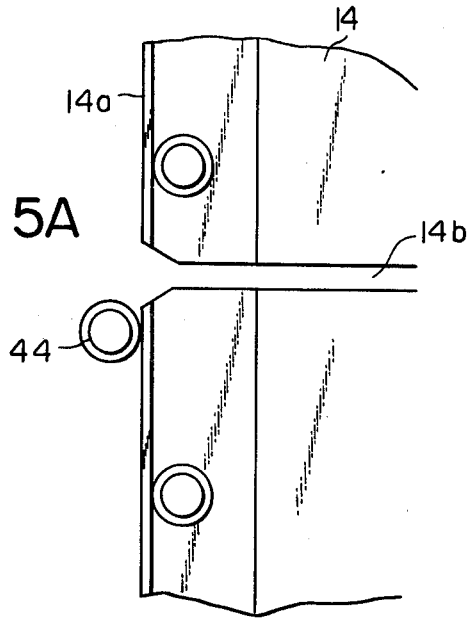
FIG. 5A is a side view taken along a line VA—VA in FIG. 4.
Figure 5B:
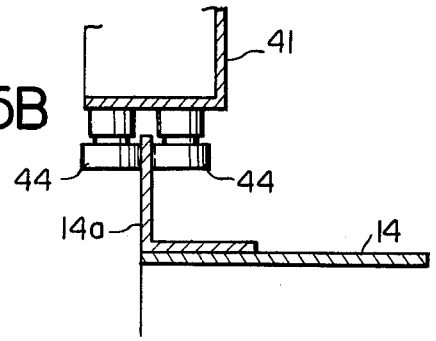
FIG. 5B is also a side view taken along a line VB—VB in FIG. 4.

The functions of the doffing and donning machine of the present invention are the automatic doffing of full packaged bobbins from the winding unit, donning of empty bobbins on said winding unit and threading of a new yarn in said unit. As shown in FIG. 1, there is provided a connecting element 39, which connects the middle part of the frame 1 and the upper part of the winding section 16. An I beam long rail 40 for the doffing and donning machine is mounted against the bottom of the connecting element 39 and extends along the entire length of the draw-texturing machine. Several driving wheels 42 and 43 on a trolley frame 41 of hanging mono-rail type, as shown in FIGS. 1 and 4, roll on the rail 40 to convey the trolley frame 41 along the rail 40. A plurality of guide rollers 44 are mounted underneath the trolley frame 41, as shown in FIGS. 4, 5A and 5B. The guide rollers 44 are so arranged that they are disposed at both sides of a bottom guide 14*a* mounted on the worker deck 14, so that by means of both the guide 14*a* and rollers 44 the trolley frame can be prevented from moving laterally. By this arrangement, there is no chance of the trolley frame 41 being jolted by shocks, even when it passes over a slit 14*b* provided on the worker deck 14.

The trolley frame 41 is provided with a travelling device 45 and a correct positioning device 46, as shown in FIG. 4, as well as three doffing units 47 arranged in three stages. The doffing units are arranged in such a way that each of the doffing units is disposed in front of each of the winding units, and a plurality of winding units are arranged in three rows, with said three rows arranged in three stages on the winding section 16. The trolley frame 41 is also provided with a drive source 48 for driving the travelling device 45, the doffing units 47 and a control mechanism 49.

TRAVELLING MECHANISM OF SAID TROLLEY FRAME

The function of the travelling device 45 and the correct positioning device 46 of the trolley frame 41, is to move the trolley frame 41, which is hanging from the rail 40, along said winding units 16 and stop said trolley frame at a position just before a winding unit 19 to be doffed. As shown in FIG. 4, the travelling device 45 comprises an air motor 50, and a power transporting element, such as a chain 51 or belt, disposed between the air motor 50 and a driving wheel 42.

CORRECT POSITIONING DEVICE

As shown in FIG. 4, the correct positioning device 46 comprises a hydraulic cylinder 52 connected to the trolley frame 41 by means of a pin, a stopper 53 mounted on a piston rod 52*a* of the hydraulic cylinder 52, and a shock absorber 54 disposed between the stopper 53 and the trolley frame 41. The stopper 53 can be lifted by means of the hydraulic cylinder 52. When stopping the movement of the trolley frame moving toward the left from the right, as indicated by an arrow C in FIG. 4, it is necessary to lift the stopper 53 and to urge said stopper 53 against a position setting member 40*a* mounted against the underside of the rail 40. In this case, the effect of any shocks occurring during this stopping operation can be reduced to a minimum by the provision of the shock absorber 54.

The functions of said travelling device 45 and the correct positioning device 46 can be controlled by means of the control mechanism 49 such a high pressured air circuit and an air valves 55, or an electric circuit and an electromagnetic valve, or a hydrid circuit consisting of hydraulic and electric circuits. The control is carried out by controlling the air pressure delivered from the drive source 48, which comprises a compressor and a pressure regulating mechanism 56 which controls the necessary air pressure, or; by controlling the electricity coming from the drive source 48, which comprises a battery or electric wiring (not shown in drawings) as well as a transformer (not shown), to obtain a given voltage.

DOFFING UNIT

Figure 6:
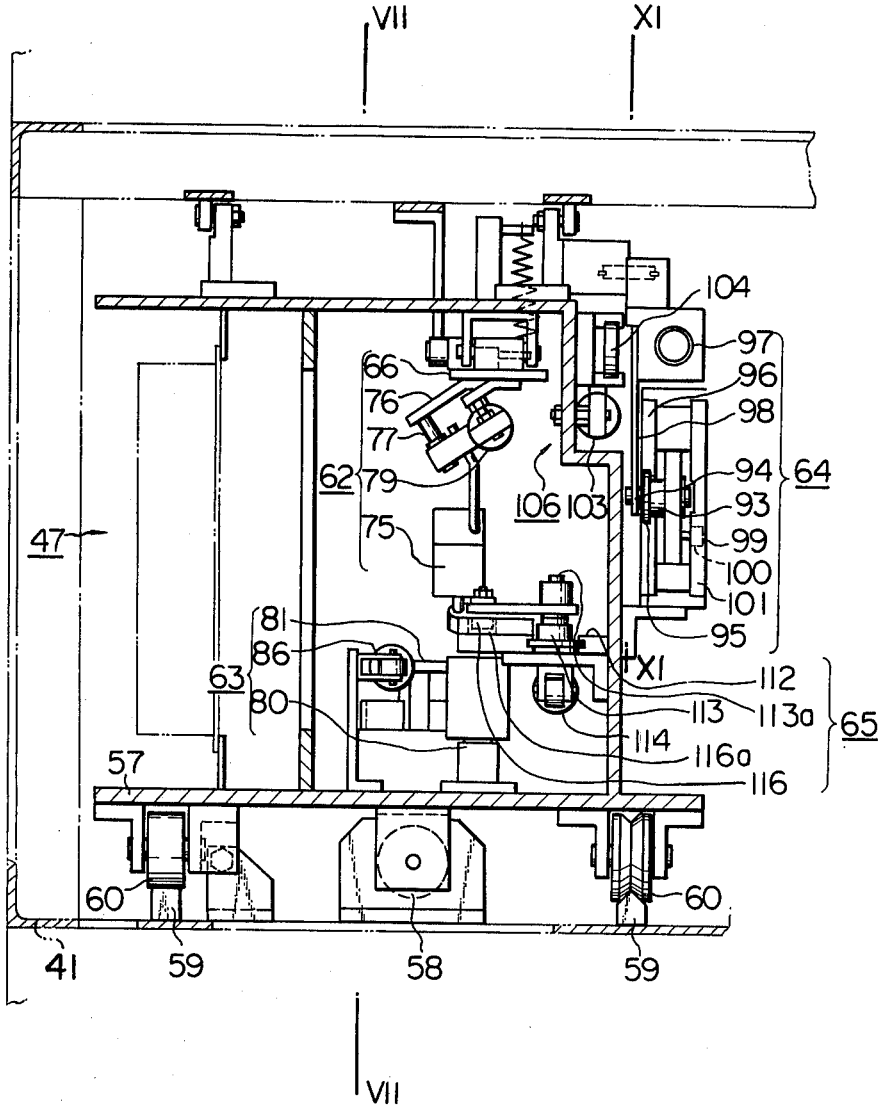
FIG. 6 is a plan view showing the back side of a doffing unit as shown in FIG. 1.
Figures 7, 10:
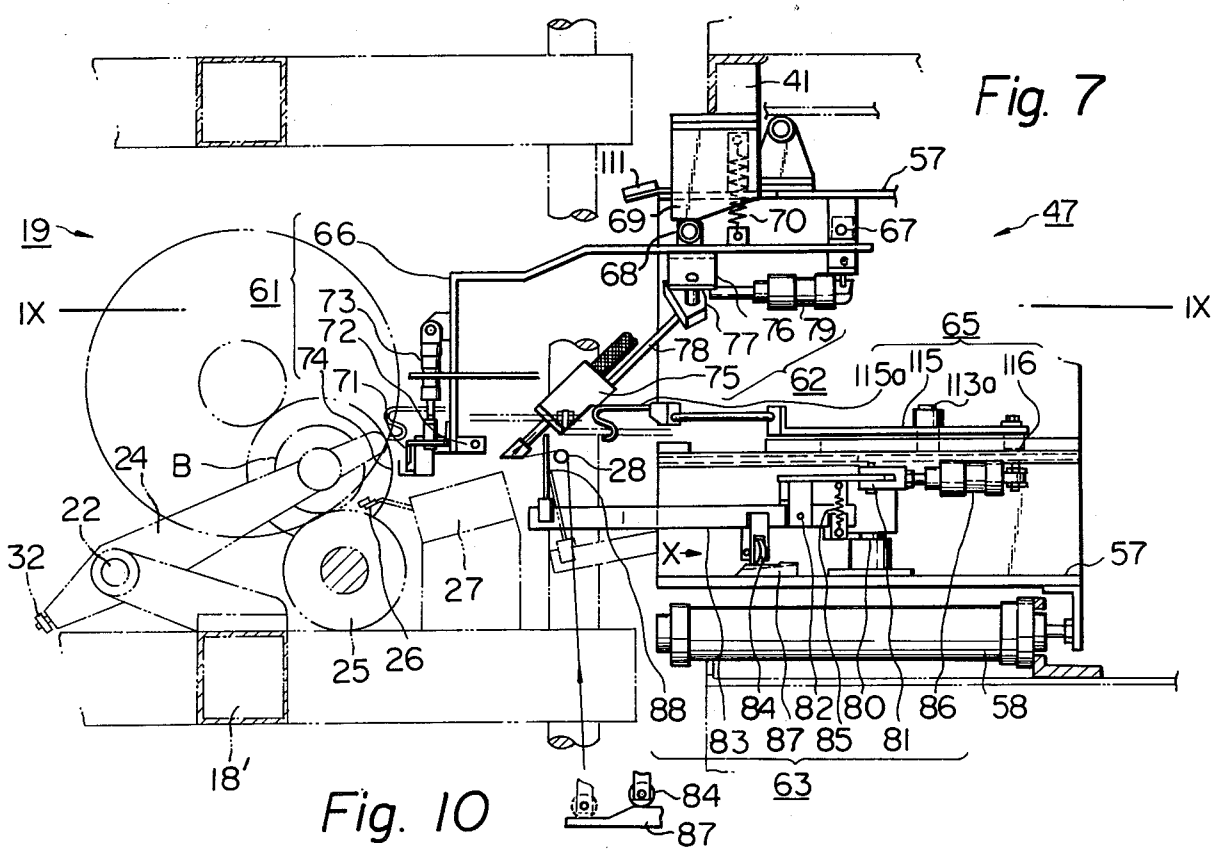
FIG. 7 is a detailed side view of a doffing unit as shown in FIG. 6 and taken along a line VII—VII in FIG. 6.
FIG. 10 is a partial front view of a device as shown in FIG. 7.

In FIG. 1, three doffing units 47 are mounted on three stages on the travelling trolley frame 41, in such a way that one doffing unit is mounted on one stage and also disposed just in front of one of the winding units of the draw-texturing machine. As shown in FIGS. 6 and 7, each doffing unit 47 is mounted on a subtruck 57, which approaches near and moves far from a winding units 19 within the trolley frame 41, i.e. it moves perpendicularly with respect to the travelling direction of the trolley frame. The subtruck 57 and trolley frame 41 are connected by a sliding cylinder 58. When compressed air is introduced into the cylinder 58, the subtruck 57, provided with wheels 60, moves on a rail 59 provided on the trolley frame 41. After stopping the trolley frame 41 at a position just before a winding unit 19 from which a package P is to be doffed, and after the subtruck 57 approaches near said winding unit 19, the doffing of the full package P from said winding unit by means of a doffing unit 47, donning of a fresh bobbin onto said winding unit and threading of a new yarn in said winding unit, the winding of a yarn onto a bobbin can be commenced.

As shown in FIG. 7, a doffing unit 47 further comprises: a cutting mechanism 61, which holds and cuts a yarn being wound on a bobbin B after it passes through the yarn path deflecting guide 28 and the traverse guide 26 on the winding unit 19; a sucking and holding mechanism 62, which sucks and holds a cut yarn end of said yarn not connected to the package but guided by means of the deflecting guide 28; a yarn passage controlling mechanism 63, which controls the yarn passage when said yarn is sucked in by means of the sucking and holding mechanism 62; a cradle swinging mechanism 64 (in FIG. 11), by which the cradle 24 of the winding unit 19 is moved in a sequence as already disclosed with respect to FIGS. 2 and 3, so that a full package P is doffed and an empty bobbin B is mounted between the bobbin holder 20 of the cradle 24 and the bobbin holder 21 of the cradle 23, and; a threading device 65, which threads a yarn onto an empty bobbin B driven by the friction roller 25 due to the action of the cradle swinging mechanism 64.

HOLDING AND CUTTING MECHANISM

Figure 8:
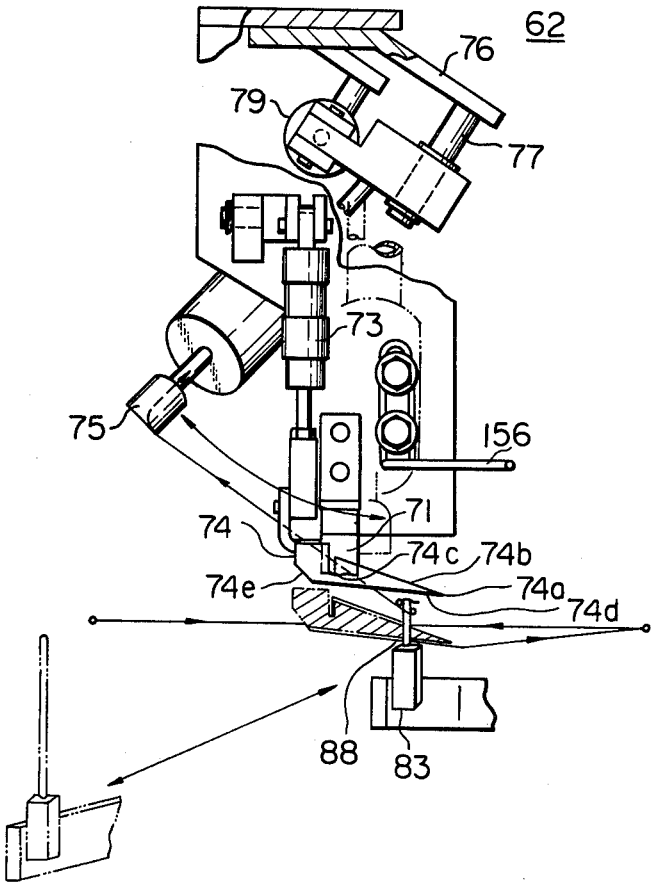
FIG. 8 is a partial front view of a device as shown in FIG. 7.

The holding and cutting mechanism 61 as shown in FIG. 7, cuts a running yarn moving from the deflecting guide 28 toward the traverse guide 26 after said yarn is arranged in a position where it can be easily sucked into the sucking and holding mechanism 62. The holding and cutting mechanism 61 together with the sucking and holding mechanism 62 are mounted on L shaped lever 66. The L shaped lever 66 is pivotably mounted on the subtruck 57 by means of a pin 67. A cam follower 68, mounted on the middle portion of the lever 66, is urged by a spring 70 against a cam surface 69 fixed on the trolley frame 41. Along with the forward and backward movement of the subtruck 57, the end of the lever 66 moves downwardly or upwardly, according to the contact relationship between the cam surface 69 and cam follower 68. As shown in FIGS. 7 and 8, the holding and cutting mechanism 61 comprises a stationary cutting edge 71 and a yarn holding guide 74, which moves upwardly and downwardly by means of a hydraulic cylinder 73 mounted on the lever 66 by means of a pin 72.

As shown in FIG. 8, the yarn holding guide 74 has an apex 74*a*, an upper side 74*b*, a vertical slit 74*c*, a bottom side 74*d* and a guide surface 74*e*. The bottom side 74*d* is slightly inclined downwardly and directed toward the center portion of the traverse of the yarn. The vertical slit 74*c* on the upper side 74*b* is for holding a yarn disposed at a position corresponding to that of the stationary cutting edge 71. When the yarn holding guide 74 is lowered, as shown by broken lines in FIG. 8, it intersects the plane of the traversing yarn running from the deflecting guide 28 (FIG. 2) toward the traversing device 27 (FIG. 2). Consequently, because of the shape of the yarn holding guide 74, as shown in FIG. 8, when the guide 74 is lowered the traversing yarn is forced to move across its surfaces. That is, with the yarn holding guide 74 lowered, as the yarn traverses from left to right, in FIG. 8, along the guide 74, it is guided by the bottom side 74*d* and the guide surface 74*e*, while as the yarn traverses from the right of the yarn holding guide 74, it mounts and moves along the upper side 74*b* of said guide 74, and finally, drops into the vertical slit 74*c*. Then, by the upward movement of the yarn holding guide 74, the yarn held by the slit 74*c* can be cut by the stationary cutting edge 71. A protecting guide 156 is provided for preventing the running yarn from coming into contact with the holding and cutting mechanism 61 while the lever 66 is moving. By moving said yarn holding guide 74 upwardly and downwardly in several cycles, the cutting of a running yarn can be definitely assured.

SUCKING AND HOLDING MECHANISM

The sucking and holding mechanism 62 must, firstly, arrange the yarn at the position at which the yarn can be easily sucked into the mechanism 62, before the yarn is cut by means of the holding and cutting mechanism 61, and; secondly, arrange the yarn at the position at which the function of the yarn threading mechanism 65 (FIG. 9) can be carried out, as will be explained in detail hereafter. As shown in FIG. 7, a suction gun 75, which sucks a yarn therein by mean of negatively pressurized air, is mounted on an arm 78, which is turnably mounted on an inclined bracket 76 fixed on the lever 66 by means of a pin 77. A turning hydraulic cylinder 79 connected to the lever 66 at its one end is connected to the arm 78 at its other end. By means of this arrangement, the arm 78 together with the suction gun 75 are moved by means of said turning hydraulic cylinder 79 along an arcuate path.

YARN PASSAGE CONTROLLING MECHANISM

In the case where the yarn path extending from the deflecting guide 28 to the sucking and holding mechanism 62 is displaced a great distance due to the turning of the arm 78, or when doffing is being carried out, there is a chance that the yarn will slip out from the hold of the mechanism 62 when it is to be threaded by the threading mechanism 65 onto a winding unit. Consequently, it is necessary to dispose a yarn passage controlling mechanism 63 midway between the deflecting guide 28 and sucking and holding mechanism 62, to firmly define the yarn path extending from the sucking and holding mechanism 62 to said yarn passage controlling mechanism 63.

Figure 9:
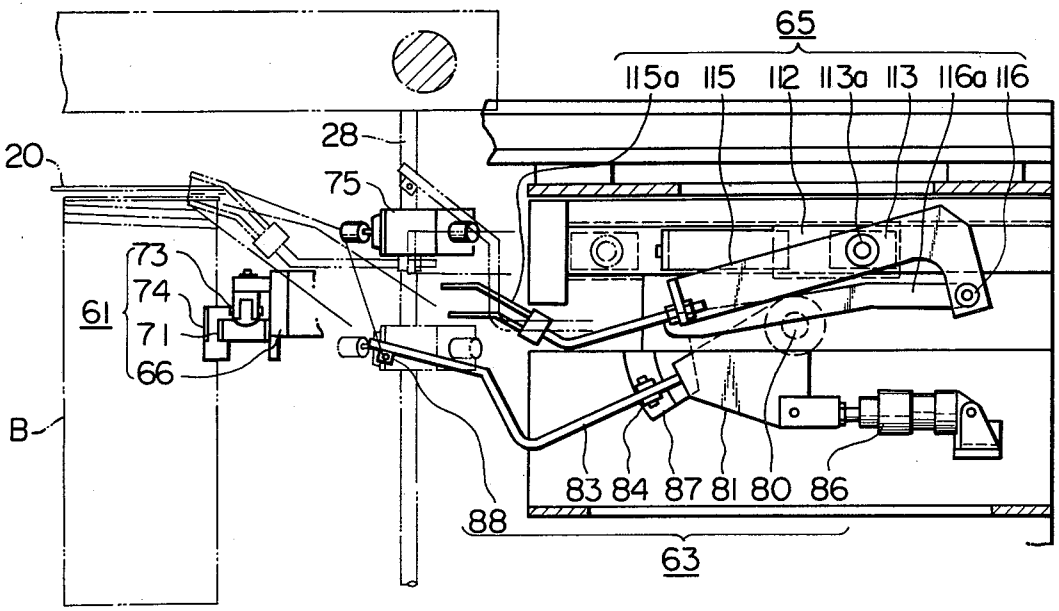
FIG. 9 is a partial plan view of a device as shown in FIG. 7 and taken along a line IX—IX in FIG. 7.

As shown in FIGS. 7 and 9, the yarn passage controlling mechanism 63 is so constructed that, a movable lever 83 is pivotably mounted on a boss 81 by means of a pin 82, so that the movable lever 83 may move upwardly or downwardly. The boss 81 is rotatably mounted on a vertical stud 80 so that it can be swung within a horizontal plane by means of a hydraulic cylinder 86. As a cam follower 84, mounted on the movable lever 83, is urged against a cam surface 87 by means of a spring 85, when the movable lever 83 is horizontal a yarn guide 88 fixed on the movable lever 83 becomes vertical. The cam surface 87 is curved as shown in FIG. 10. After the subtruck 57 approaches near a winding unit, the yarn passage controlling mechanism 63 is moved to a position indicated by broken lines in FIGS. 7 and 9 by means of the hydraulic cylinder 86. By the reverse operation of the hydraulic cylinder 86, the top of the yarn guide 88 is disposed at the position where it is projected upwardly from the level of the deflecting guide 28, due to the cam follower 84 coming into contact with the higher surface of the cam 87 after the movable lever 83 is turned around the vertical stud 81 laterally. As the yarn guide 88 is already lifted from a position below the deflecting guide 28 to a position above the deflecting guide 28, and is disposed at a position outside the traversing range of the yarn (i.e., as shown by broken lines in FIG. 9) and between the deflecting guide 28 and the traversing device 27, the yarn guide 88 can be projected upwardly from the horizontal plane, within which the yarn is traversed. The movable lever 83 can be rotated further to a position as shown by solid lines in FIGS. 7 and 9, and the configuration of said cam surface 87 is so made that it induces such a displacement of the movable lever 83. A yarn extending from the deflecting guide 28 to the traversing device 27 can be cut by means of the holding and cutting mechanism 61 and, then, the cut yarn can be sucked into the sucking and holding mechanism 62. Thus, the yarn is sucked into the sucking and holding mechanism 62 after being guided by the deflecting guide 28 and the yarn passage controlling mechanism 63.

CRADLE SWINGING MECHANISM

Figure 11:
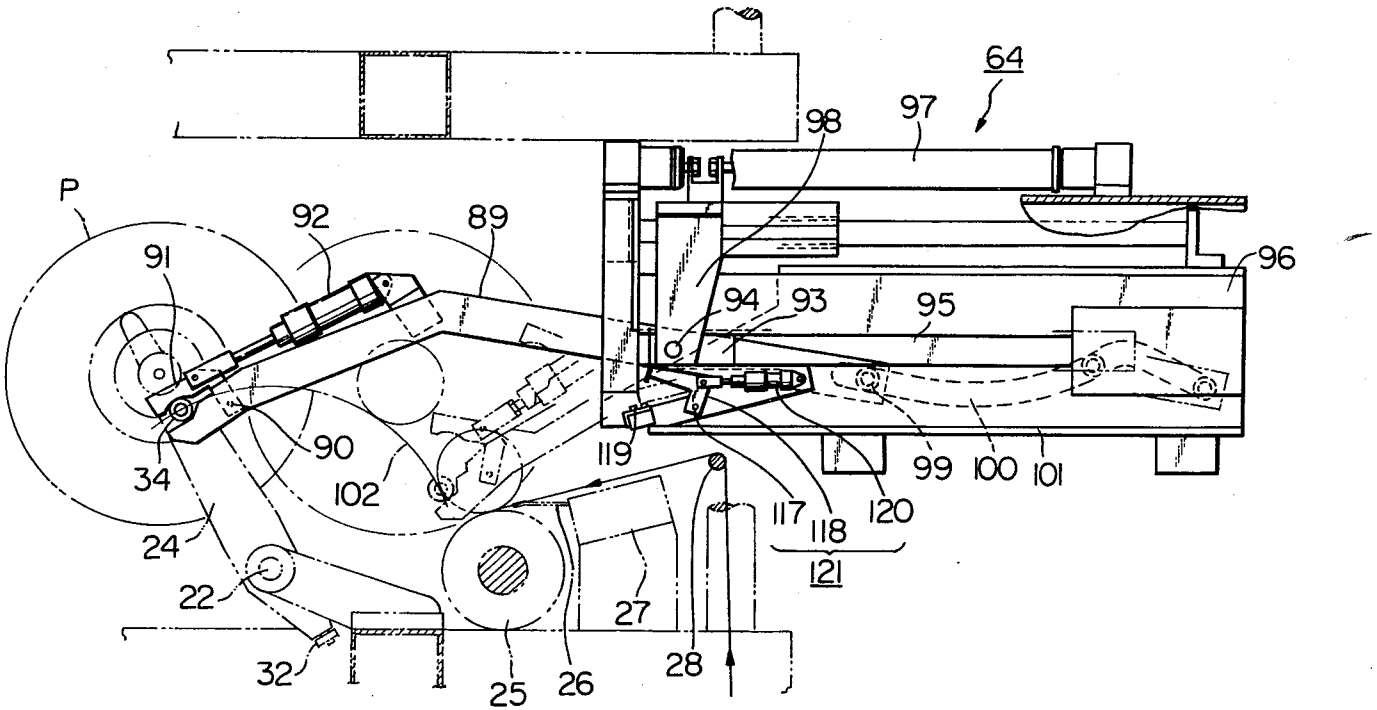
FIG. 11 is a partial side view of a device shown in FIG. 6 and taken along a line XI—XI in FIG. 6.

Referring to FIG. 11, after the yarn is held by means of the sucking and holding mechanism 62, the cradles 23 and 24 of the winding unit 16 are turned by means of the cradle swinging mechanism 64, so that a full package P is doffed from the winding unit and an empty bobbin B is donned onto the winding unit. It is preferable that the cradle swinging mechanism 64 be able to turn the cradles 23 and 24 when a package is either small or full. When using a cradle swinging mechanism, wherein said mechanism clamps one of the cradles directly, and when said cradle is pivoted, a holding head of such a swinging mechanism must have a complicated link mechanism like a hinged joint of a human wrist, so that said holding head can be moved along with said cradle.

The embodiment of the cradle swinging mechanism 64 of the present invention, as shown in FIG. 11, is so constructed that this mechanism clamps the guide roller 34 mounted on the cradle 24, as shown in FIG. 3, and also turns the cradle 24 around the shaft 22. As a result, the guide roller 34 can be moved along a circular path around the shaft 22. Therefore, the cradle swinging mechanism 64 of the present invention is so constructed that the cam mechanism within this mechanism can move a member, which holds said guide roller 34, along said circular path.

The cradle swinging mechanism 64 is mounted on the subtruck 57 as shown in FIG. 6. A side view of the cradle swinging mechanism 64 is shown in FIG. 11. As shown in FIG. 11, an upper finger 91 is pivotably mounted on the top of a cradle swinging lever 89 by means of a pin 90. The finger 91 is connected to a hydraulic cylinder 92 so that the finger 91 can be swung around the pin 90. The cradle swinging lever 89 is slidably mounted within a sliding member 93 by means of a pin 94. A cam plate 96 fixed on the subtruck 57 (FIG. 6) has a grooved cam 95 of straight configuration which guides the sliding member 93. The sliding member 93 is connected to a cylinder 97 by a bracket 98. A cam follower 99 is mounted at the end of the cradle swinging lever 89. A cam plate 101 has a curved and grooved cam 100, in which the cam follower 99 is engaged, so that the cam 100 guides the cam follower 99. Consequently, the opposite end of the cradle swinging lever 89 can approach near the winding unit 16 by projecting the piston from the cylinder 97, and can be controlled by the pin 94 and cam follower 99, so that said end follows an arced path 102, which is defined by the guide roller 34 mounted on the cradle 23 of the winding unit 16.

When the cradles 23 and 24 are to be turned, after the finger 91 of the cradle swinging lever 89 is in its opened and rearward condition, the cradle swinging lever 89 first proceeds along a straight line by means of the hydraulic cylinder 97. Then, the front end of the lever 89 comes to a position which the arced path 102 of the guide roller 34 passes through. Then the front end of the lever 89 moves along the arced path 102 along with the forward movement of the lever 89, so that the guide roller 34 can be arranged between the front end of the lever 89 and the finger 91. This engagement of the guide roller 34 is maintained even when the lever 89 moves further forward. The forward movement of the lever 89 is continued until the full package P comes to a position, where it must be separated from the front end of the lever 89. Before the cradle swinging lever 89 commences its movement backward, after the full package P is released from the clamp of the cradles, the guide roller 34 is clamped by means of the lever 89 and the finger 91 by the operation of the hydraulic cylinder 92. The operation of the cylinder 92 is induced by a signal provided by a timer or detector (not shown), such as a limit switch, which detects the fact of the package being released from the lever 89. Along with the backward movement of the cradle swinging lever 89 by means of the hydraulic cylinder 97, the cradles 23 and 24 are also turned around the shaft 22. As shown in FIGS. 2 and 3, the bobbin holders 20 and 21, mounted on the cradles 24 and 23, respectively, hold the empty bobbin B between them and by the above-mentioned turning of the cradles 23 and 24 said empty bobbin is moved to the position where it contacts the surface of the friction roller 25. The empty bobbin is pressed by a given pressure against the friction roller 25 by means of the cradle reversing mechanism 64 and, consequently, the rotational speed of the empty bobbin can be increased quickly to its given speed. As the cradle swinging mechanism 64 moves along the same path as that of the guide roller on the cradle 24, the doffing of the full package from the winding unit can be always carried out whether said package is small or full.

Figure 12:
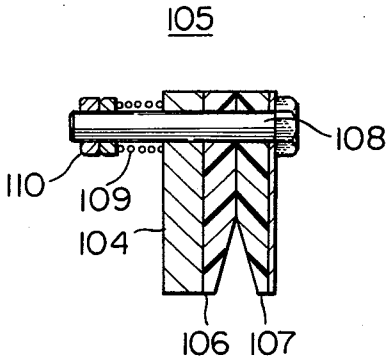
FIG. 12 is a detailed cross sectional view of a bobbin holder braking device.
Figure 14:
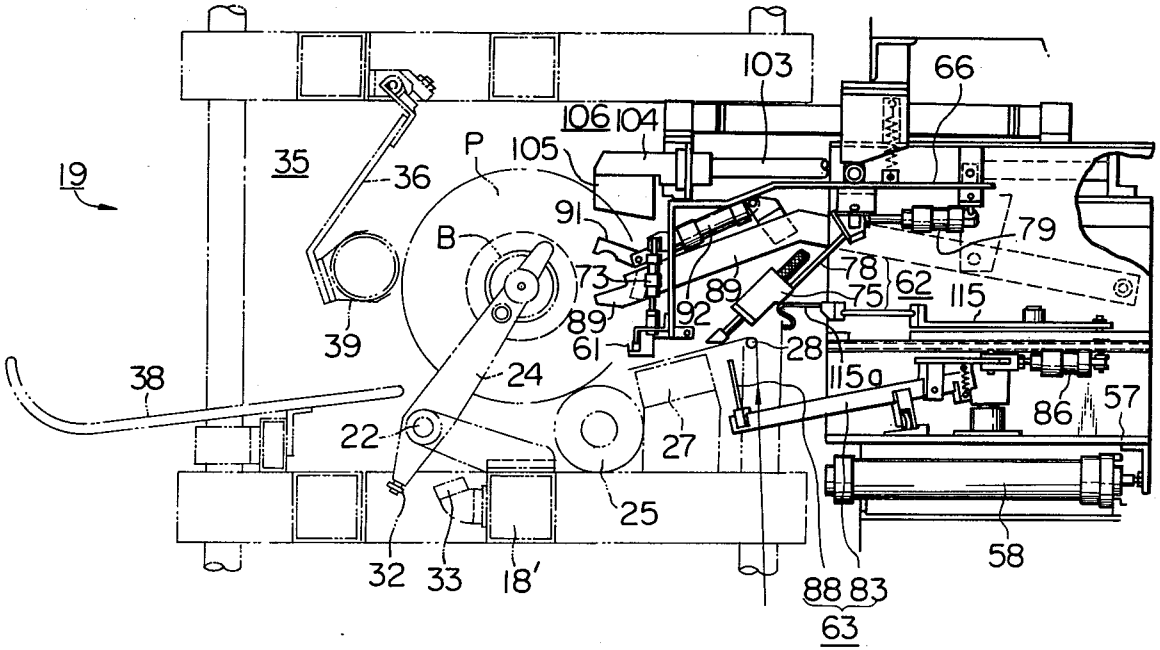
FIG. 14 through FIG. 18 are side views showing several operational conditions of a doffing and donning device as shown in FIGS. 4 through 13.

If the turning of the full package P is not stopped when it is discharged on the full bobbin pan 38, there is chance that the package will be dropped from the full bobbin pan, or that the surface of the package will be damaged by a sliding movement between the surfaces of the full package and the bobbin pan. To avoid such drawbacks, this embodiment includes, as shown in FIG. 6, a hydraulic cylinder 103 arranged near the cradle swinging mechanism 64, as shown in FIG. 12, and a bobbin holder brake 105 moved to and fro by means of the cylinder 103. As shown in FIG. 12, the bobbin holder brake 105 has two rubber plates 106 and 107 arranged adjacent to a brake lever 104. The rubber plates 106 and 107 are arranged in such a way that they form a wedge defined by two of the surfaces thereof. The brake lever 104, and two rubber plates 106 and 107 are mounted on an axle 108. A compression spring 109 is disposed between the brake lever 104 and nuts 110 screwed on said axle 108, so that the pressure between said two rubber plates is adjustable by adjusting the nuts 110. As shown in FIG. 14, when the bobbin holder brake 105 (in FIG. 14) moves forwardly by means of the hydraulic cylinder 103 (in FIG. 6), the bobbin holder brake 105 comes to a position at which its path and the path of the bobbin holder 20 on the cradle 24 intersect each other.

As a result of the above described arrangement, by urging the bobbin holder brake 105 against the bobbin holder 20 after the turning of the cradle by means of the cradle swinging mechanism, the turning of the full package P becomes completely stopped. When the cradle 24 is turned further, the bobbin holder 20 forces the rubber plates 106 and 107 of the bobbin holder brake 105 apart. When a limit switch (not shown) detects the fact that the bobbin holder 20 has come into contact with the bobbin holder brake 105, a signal provided by said limit switch can be used for the sequential operation of the cylinder 97 of the cradle swinging mechanism 64, in such a way that after a predetermined time the cylinder 97 pushes said bobbin holder brake 105 forwardly. After this forward movement it is necessary to move the bobbin holder brake 105 backwardly.

As a device for stopping the operation of the cradle swinging mechanism, a kind of hydraulic cylinder using pressured oil is suitable. If the cradle swinging mechanism 64 turns the cradles 23 and 24, without an empty bobbin being held thereby, up to a position where an empty bobbin should come into contact with the friction roller 25, problems, such as damage to some of the elements, might result. To avoid this, a photo-cell device 111 may be arranged on the subtruck 57, as shown in FIG. 7. If, for example, the existance of an empty bobbin is not detected by the device 111, the cradles 23 and 24 are moved backwardly by the operation of the hydraulic cylinder 97 (in FIG. 11).

YARN THREADING MECHANISM

In FIGS. 9 and 10, when the running speed of an empty bobbin B urged against the friction roller 25 by means of the cradle swinging mechanism 64 becomes a given high speed, the yarn extending from the deflecting guide 28 to the sucking and holding mechanism 62 via the yarn guide 88 of the yarn passage controlling mechanism 63, must be threaded into the winding unit by means of the threading device 65.

As shown in FIGS. 6, 7 and 9, the threading device 65 comprises: a slide groove 112 running parallel to the direction of movement of the substruck, and disposed above the yarn passage controlling mechanism 63; a sliding block 113, which slides within the slide groove 112; a hydraulic cylinder 114 which slides the sliding block 113 along the slide groove 112; a swing lever 115, provided with a pair of guide bars 115*a*, slidably mounted on the slide block 113 by means of a pin 113*a*; a cam follower 116 mounted on the swing lever at its L shaped rear end, and; a grooved cam 116*a* within which said cam follower 116 is loosely engaged. The guide bars 115*a* are bent so that they can engage a yarn and stop it. By the operation of the hydraulic cylinder 114, the guide bars 115*a* are moved from the position shown by solid lines to the position shown by broken lines in FIGS. 7 and 9, so that between the guide bars 115*a* the bobbin holder 20 can be inserted. During this movement, the guide bars 115*a* scoop a yarn to be threaded, which extends from the deflecting guide 28 to the sucking and holding mechanism 62 via the yarn guide 88 of the yarn passage controlling mechanism 63, from underside of said yarn. When the bobbin holder 20 is inserted between the guide bars 115*a*, the yarn comes to a position, where the yarn path intersects the face of the bobbin holder 20, and, finally, the dent 20*a* on the bobbin holder 20 catches said yarn to be threaded on the winding unit.

When the threading of a yarn onto the bobbin holder 20 is accomplished, the yarn tension appearing on the yarn extending between the holder 20 and the sucking and holding mechanism 62 becomes high, and, therefore, said yarn can be broken. It is, also, preferable to arrange a cutting mechanism 121 midway between the bobbin holder 20 and the sucking and holding mechanism 62. In the embodiment as shown in FIG. 11, there are an L shaped cutter blade 118, which swings around a pin 117 fixed on the cam plate 101 of the cradle swinging mechanism 64, and a stationary supporting deck 119. The cutter blade 118 is connected to a hydraulic cylinder 120. By the operation of the hydraulic cylinder 120, the yarn can be cut by urging the cutter blade 118 against the supporting deck 119.

DOFFING AND DONNING MECHANISM

As shown in FIGS. 14 through 18, when the bobbin B on a winding unit 19 of a winding section 16 (in FIG. 1) supports a full package P which must be doffed, the trolley frame 41 (in FIG. 4) is moved to a position just in front of the winding unit 19 to be doffed. Then, the subtruck 57 on the trolley frame 41 approaches said winding unit 19. By the forward movement of the subtruck 57 toward the winding unit, the L shaped lever 66 supporting the holding and cutting mechanism 61, and also the sucking and holding mechanism 62, is inclined downwardly. Then, by the turning of the arm 78 of the holding and sucking mechanism 62 the suction gun 75 comes to a position where the yarn can be sucked thereinto after the suction of the suction gun 75 is commenced. Almost simultaneously, the movable lever 83 of the yarn passage controlling mechanism 63 is turned so that the yarn guide 88 moves from the position below the deflecting guide 28, as shown in FIG. 14, to the position above the guide 28. By the further turning of the movable lever 83, the yarn guide 88 is projected upwardly between the deflecting guide 28 and the traversing device 27. Then, the yarn holding guide 74 of the holding and cutting mechanism 61 decents downwardly so that it will intersect the plane within which a yarn traverses between the deflecting guide 28 and the traversing device 27. As a result, the yarn held by the slit 74*c* (in FIG. 8) extends from the deflecting guide 28 to the traversing device 27 after passing through the yarn guide 88. After that, the yarn holding guide 74 is lifted upwardly so that yarn is cut by the stationary cutting edge 71, and, then, the cut yarn end is sucked into the suction gun 75 of the sucking and holding mechanism 62.

Figure 13:
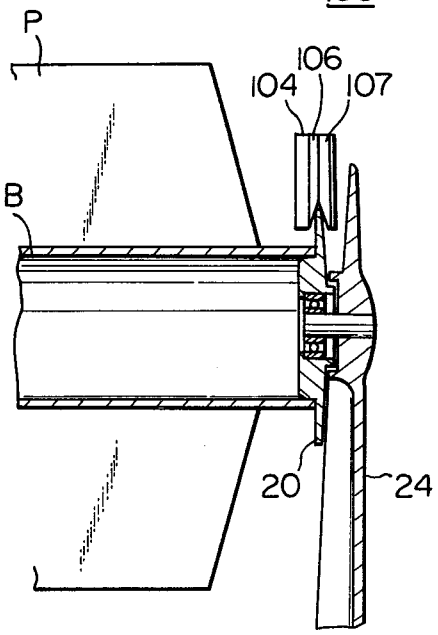
FIG. 13 is a cross sectional view of a bobbin holder braking device showing the operational condition thereof.
Figure 15:
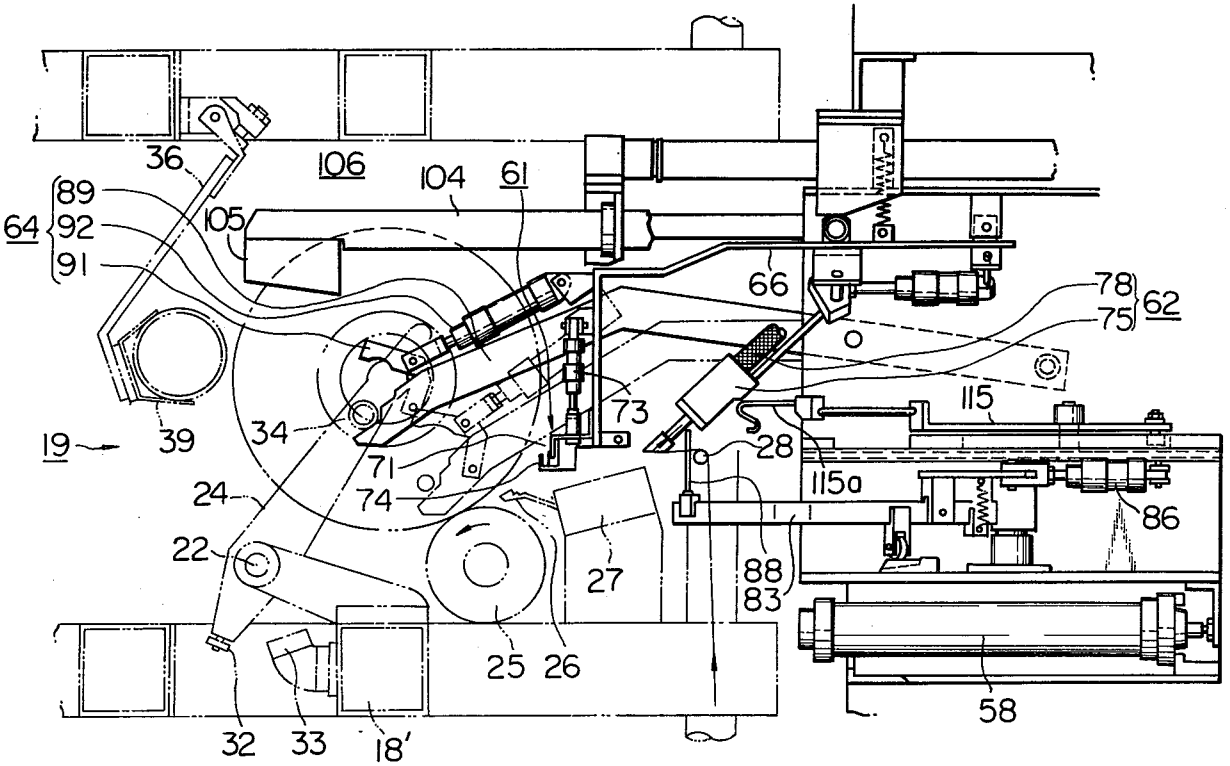

By positioning the bobbin holder brake 105 at its given position near the hydraulic cylinder 103 (in FIG. 6), and also moving the cradle swinging lever 89 forward with the finger 91 of the cladle swinging mechanism 64 opened, the front end of the cralde swinging lever 89 moves along the passage of the guide roller 34 mounted on the cradle 24, as shown in FIG. 15. After the finger 91 is closed against the lever 89, so that the guide roller 34 can be held by the cradle swinging lever 89 and the finger 91, and then the cradle swinging lever 89 moves further forward, the cradle 24 of the winding unit turns and the bobbin holder 20 (in FIG. 13) is urged against the bobbin holder brake 105, which stops the turning of the holder 20.

Figure 16:
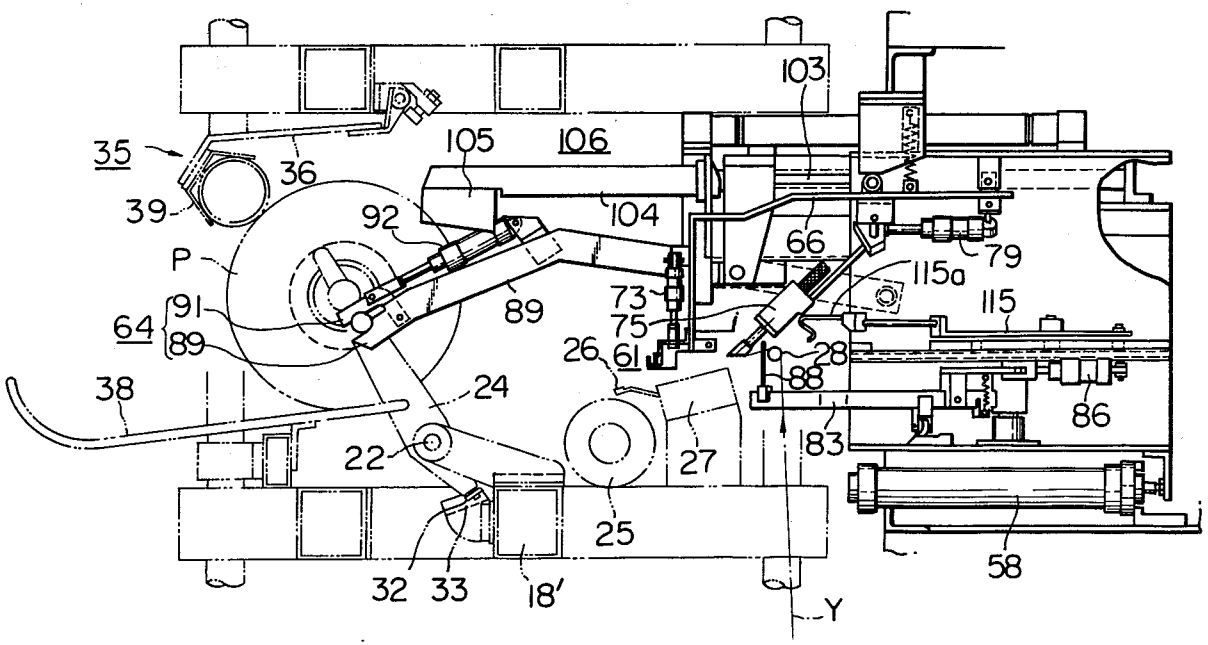

By the further turning of the cradle 24, as mentioned above, the distance between the bobbin holder 20 and the bobbin holder 21 is widened. This results in the full package P being transferred onto the full package pan 38, as shown in FIG. 16. In this case, the empty bobbin supporter 35 is moved upwardly and, after the full package P passes underneath it, said supporter resumes its ready position by its own weight.

Figure 17:
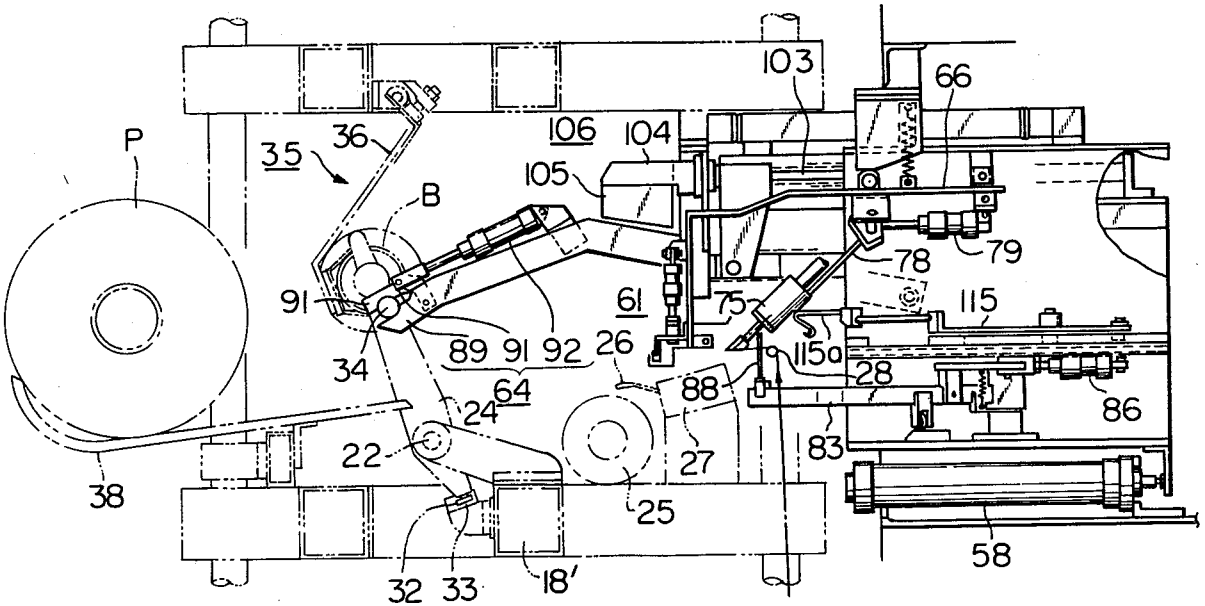
Figure 18:
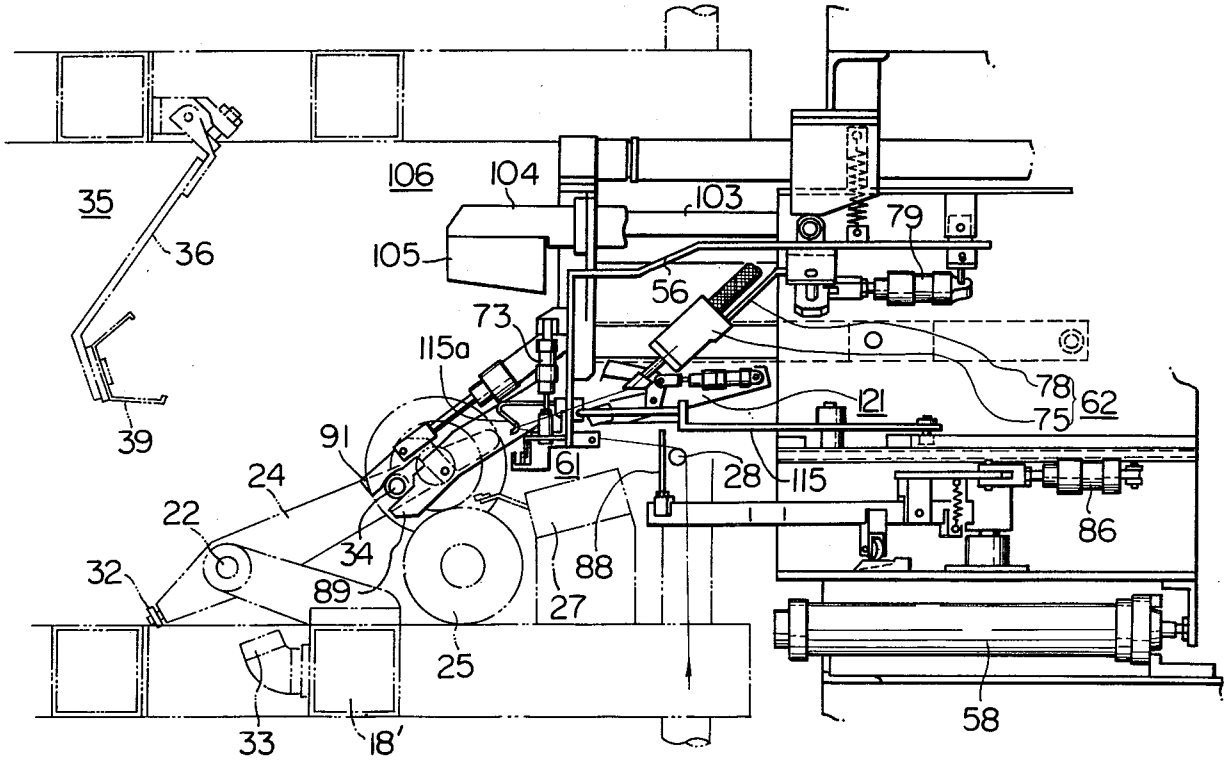

After a full package P is doffed from the winding unit, the cradle 24 is turned to a position near said winding unit by means of the cradle swinging mechanism 64 and, then, the cradles 23 and 24 receive an empty bobbin which is held on the empty bobbin supporter 35 resting at its ready position, as shown in FIG. 17. Then, by the cradle swinging mechanism 64, the cradles are moved closer to the winding unit so that the empty bobbin B is urged against the friction roller 25, as shown in FIG. 18, and the normal turning speed of said bobbin is commenced. If no empty bobbin is held by the cradles, the guide roller 34 is released from the engagement with the cradle swinging mechanism 64 and, thus, said cradles never obstruct any of the other necessary operations.

When the swing lever 115 of the threading device 65 (in FIG. 9) is moved forwardly, the pair of guide bars 115*a* of the swing lever 115 scoop the yarn, extending from the deflecting guide 28 to the suction gun 75 on the sucking and holding mechanism 62 via the yarn guide 88 of the yarn passage controlling mechanism 63, between the guide 88 and the suction gun 75. Then, the yarn is brought into contact with the surface of the bobbin holder 20, so that said yarn can be engaged with the dent of the bobbin holder 20. After that the yarn extending from the bobbin holder 20 to the suction gun 75 is cut out by means of the yarn cutting device 121 (in FIG. 11). The suction of the suction gun 75 is then stopped or weaken. As long as the threading of a yarn on an empty bobbin is carried out successfully, there is no bad influence on said yarn caused by the suction of the suction gun 75 being stopped. If the threading fails and the suction of the suction gun is stopped, a reduction of the yarn tension occurs. Consequently, in such a case, it is necessary to cut the yarn by the cutter 7 after detecting the lower tension of such a yarn by means of the feeler 15. This is to prevent such a yarn from wrapping itself around a roller, which is a frequent occurrance in the case of miss threading on a conventional device. The good threading condition or miss threading condition can be detected by means of a photo-cell. If miss threading does occur, the above mentioned threading sequence may be repeated.

When the swing lever 115 of the threading device 65 is slowly moved backwardly, the yarn can be disposed from the bobbin holder 20 toward an empty bobbin in such a way that the yarn tension will be decreased in accordance with the backward movement of the lever 115. This allows a closely wound transfer tail wind to be wound onto the empty bobbin. When the swing lever 115 moves backwardly fast, the yarn is held by the traverse guide 26 of the traversing device 27, after the engagement between said yarn and the swing lever 115 is released, and thus, the lateral traverse of the yarn is commenced, so that the yarn is wound on the empty bobbin in a cross winding.

After all of the elements of the doffing and donning unit are returned to their ready positions, the trolley frame is moved to a position just before another winding unit which must be doffed. The operations of removing a doffed full package P from the full package pan or charging an empty bobbin onto the empty bobbin supporter 35 can be carried out manually or mechanically.

As explained in detail above, one doffing and donning machine of the present invention can be assigned for a large number of winding units. Consequently, one doffing and donning machine can be used for a plurality of draw texturing machines. To fully utilize the capability of one doffing and donning machine, travelling guide rails for the doffing and donning machine can be disposed between the draw-texturing machines.

Figure 19:
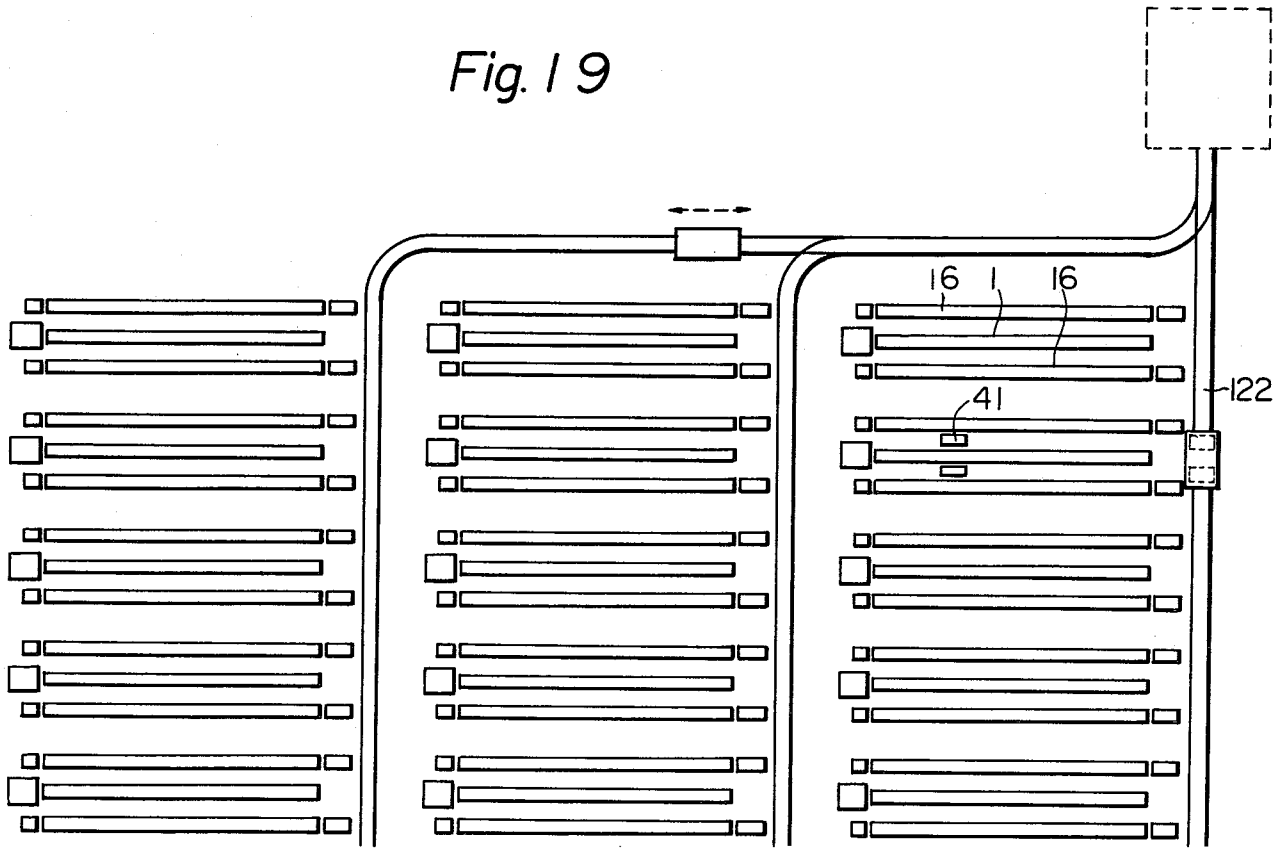
FIG. 19 is a diagrammatical drawing showing a travelling line for a doffing and donning machine of the present invention.
Figure 20:
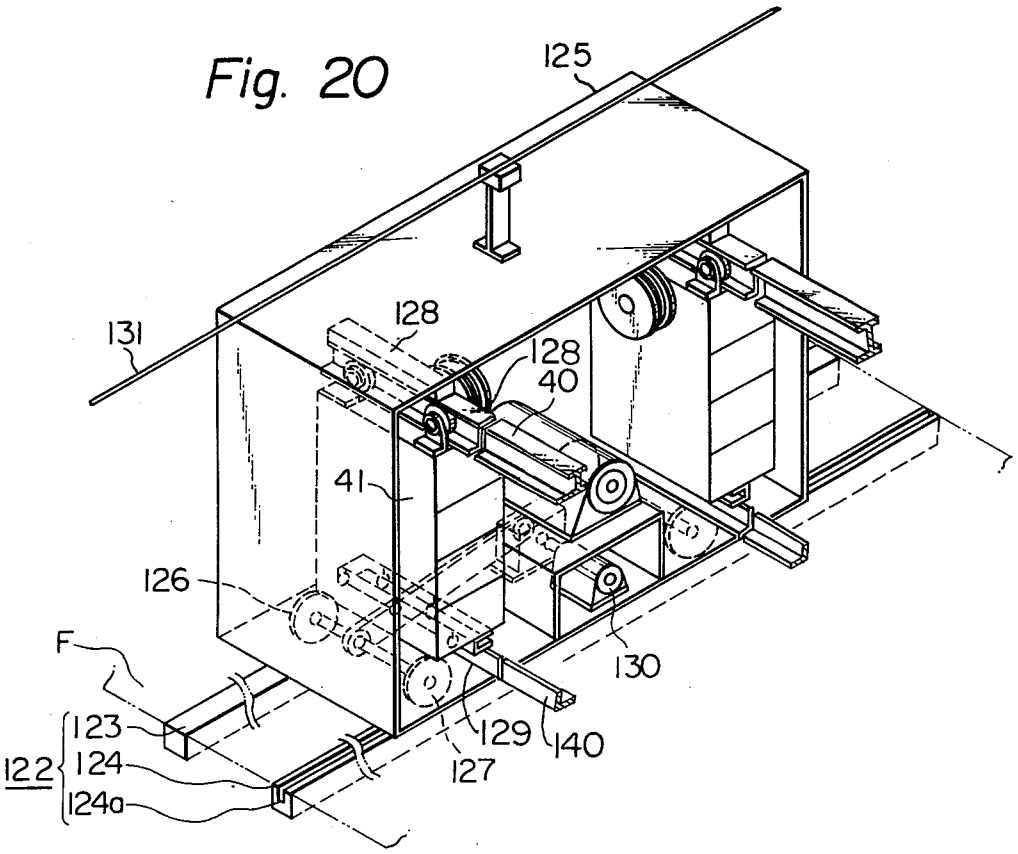
FIG. 20 is a perspective view of a main travelling truck.

As shown in FIG. 19, as an example, a plurality of draw-texturing machines, which comprise a main frame 1 and a winding section 16 arranged at both sides of said main frame 1, can be arranged in several rows and several parallel arrangements. A hanging monorail type trolley frame 41 can be moved within the space (aisle) between each main frame 1 and winding section 16. One end of each draw-texturing machine can be connected to a main rail 122. As shown in FIG. 20, the main rail 122 comprises a flat top rail 123, arranged at the same level as the ground surface F, and a longitudinal guide rail 124, which is provided with a guiding groove 124*a*. The top surface of the rail 124 is also arranged at the same level as the ground surface F.

As a main truck 125 travels along the main rail 122, the trolley frame 41 of the present invention can be moved up to one end of a draw-texturing machine. The main truck 125 is provided with wheels 126 running on the flat top rail 123, and wheels 127 running on the longitudinal guide rail 124. All of or some of the wheels 126 and 127 are directly driven by a motor 130. Within said main truck 125, there is a small rail 128 arranged perpendicularly with respect to the running direction of the main truck 125. The rail 128 can be connected to a rail 40 of the doffing and donning machine when the main truck 125 is stopped at the end of a draw-texturing machine. A guide rail 129, provided for preventing lateral movement of the trolley frame, is connected to a bottom rail 14*a* mounted on a worker deck 14 as shown in FIG. 1. The main truck 125 is connected to an electric source by means of a trolley 131, so that the motor 130 is driven electrically. Furthermore, if necessary, it is possible to both supply the electricity to the doffing and donning machine as well as to supply compressed air by using a compressor.

What is claimed is:

1. A doffing and donning machine for doffing a full package from a winding unit and donning an empty bobbin onto said winding unit, wherein a plurality of said winding units is arranged in several rows, said rows being disposed in a common vertical plane, each row being mounted on a stage within a package stand of a textile machine, comprising:

a trolley frame mounted for horizontal movement along said package stand;

a plurality of subtrucks mounted on said trolley frame for movement relative to said frame toward and away from said rows of winding units; and one doffing and donning mechanism mounted on each of said subtrucks;

each said doffing and donning mechanism comprising a yarn passage controlling means for controlling and positioning the yarn in a predetermined yarn path extending from a yarn passage deflecting guide of a winding unit to the bobbin via a traverse guide, a cutting means for holding and cutting a yarn in said predetermined path between the deflecting guide and the traverse guide, a sucking and holding means for sucking in and holding the cut yarn end extending from the deflecting guide; and a cradle swinging means for turning cradles on the winding units after said yarn passage is controlled, and said yarn is cut by said cutting means and held by said sucking and holding means, so that said cradles doff a full package being held by said cradles from said winding unit and don a fresh bobbin onto said winding unit.

2. A doffing and donning machine as claimed in claim 1, wherein said doffing and donning mechanism further comprises a means for threading a yarn on an empty bobbin pressed on a friction roller by means of the cradle swinging means, and driven frictionally by the friction roller.

3. A doffing and donning machine as claimed in claim 2, wherein said threading mechanism comprises:

a swing lever which moves toward a dent disposed on a bobbin or bobbin holder, which dent catches a yarn to be wound on a bobbin;

at least two guide bars of bent configuration fixedly mounted on said swing lever at the front end thereof, and;

a controlling means for the movement of said guide bars between one position, at which the yarn is caught by said guide bars, and another position, at which said dent comes to a position between said two guide bars.

4. A doffing and donning machine as claimed in claim 1, wherein, said doffing and donning mechanism further comprises a braking and stopping means for braking and stopping the doffed full package by clamping a flange of the bobbin holder.

5. A doffing and donning machine as claimed in claim 1, wherein said holding and cutting means comprises:

an L shaped lever, the moving passage of which intersects the traversing plane within which a yarn is traversed;

a yarn holding guide having an upper inclined surface, the forward end of which is situated below the rear end of said guide, and also a vertical slit for catching a yarn, said yarn holding guide being pivotablly mounted on said L shaped lever so that said yarn holding guide can be moved along a passage intersecting the plane in which a yarn traverses, and;

a cutting edge disposed at a position corresponding to that of said slit of said yarn holding guide.

6. A doffing and donning machine as claimed in claim 5, wherein said yarn passage controlling means comprises:

a movable lever provided with a yarn guide, wherein said guide moves from the outside to the inside of the yarn traversing region of said winding unit, so that the yarn passage of the traversing yarn is fixed at a given position disposed between said yarn guide and said yarn holding guide of said holding and cutting means.

7. A doffing and donning machine as claimed in claim 1, wherein said cradle swinging means comprises:

a cradle swinging lever moving along a passage defined by a guide roller disposed on a swingable cradle of a winding unit;

a clamping means clamping said guide roller and arranged on said cradle swinging lever at the front end thereof, and;

a positive moving device means for said cradle swinging lever, for moving said lever along the same passage as the guider roller.

* * * * *

UNITED STATES PATENT OFFICE
CERTIFICATE OF CORRECTION

Patent No. 4,079,898 Dated March 21, 1978

Inventor(s) Shiro Murakami, et al

It is certified that error appears in the above-identified patent and that said Letters Patent are hereby corrected as shown below:

In the Abstract, line 8: "on" should be --. On--.

Column 11, line 32: "existance" should be --existence--.

line 48: "substruck" should be --subtruck--.

Column 12, line 60: "cladle" should be --cradle--.

Column 16, line 12: "pivotablly" should be --pivotably--.

line 38: "guider" should be --guide--.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*